US006352306B1

(12) United States Patent
Dreiling

(10) Patent No.: US 6,352,306 B1
(45) Date of Patent: Mar. 5, 2002

(54) STADIUM SEAT

(75) Inventor: David L. Dreiling, Manhattan, KS (US)

(73) Assignee: It's Greek to Me, Inc., Manhattan, KS (US)

( * ) Notice: Subject to any disclaimer, the term of this patent is extended or adjusted under 35 U.S.C. 154(b) by 0 days.

(21) Appl. No.: 09/620,834

(22) Filed: Jul. 21, 2000

(51) Int. Cl.[7] ..... A47C 1/08
(52) U.S. Cl. ..... 297/252
(58) Field of Search ..... 297/252, 250.1, 297/331, 188.1, 219.12, 219.1

(56) References Cited

U.S. PATENT DOCUMENTS 653,105 A * 7/1900 MacLeay
2,004,237 A * 6/1935 Costello
2,792,875 A * 5/1957 Pirrone
2,865,433 A * 12/1958 Warner
3,066,980 A * 12/1962 Clute
5,533,219 A * 7/1996 Meyers

* cited by examiner

*Primary Examiner*—Milton Nelson, Jr.
(74) *Attorney, Agent, or Firm*—Hovey, Williams, Timmons & Collins

(57) ABSTRACT

A stadium seat for semi-permanent attachment to a stadium bench, the seat having a frame with a back and a seat portion, the back portion being connected to the stadium seat by a clamp secured to the stadium seat and the stadium bench by a bolt. The seat portion of the frame carries a cushion which in a position of use is over the stadium bench, but which cushion may be swung to a storage position beneath the front portion of the stadium bench which extends over the riser which supports the stadium bench whereby to protect the cushion during storage from wear and weather.

9 Claims, 2 Drawing Sheets

38
32
10
34
40
66
70
72
16
74
42
12
18
78
20
22
14
76

66
40
10
70
72
32
62
54
48
20
28
58
36
12
68
78
26
18
74
50
44
52
24
56
30
46
22
42

STADIUM SEAT

BACKGROUND OF THE INVENTION

1. Field of the Invention

A seat for semi-permanent attachment to a stadium bench, the seat having a cushion which is usable as a seat when in a horizontal position over the top of the stadium bench. The cushion may be placed in a storage position vertically disposed beneath the portion of the stadium bench which extends over the riser on which the stadium bench is supported. Semi-permanent attachment to the stadium bench of the seat is accomplished by means of a clamp at the rear of the frame of the seat, which clamp engages the rear wall of the stadium bench and is held in position by means of a bolt which couples the clamp with the seat frame.

2. Description of the Prior Art

When viewing athletic events from stadiums, the spectator is usually required to sit on a flat, hard bench of metal or wood which is supported in the stadium by stepped risers whereby to present tiered seating so that all in the stadium may view the event taking place therein.

It is known to provide supplemental seating which provides greater comfort for the spectator by utilizing a seat which has a frame and a cushion and a back member which may be positioned with respect to the stadium bench to provide a cushioned seat and a backrest for the spectator. Usually such stadium seats are rented by vendors and taken into the stadium by the user, temporarily attached to the stadium bench and then left when the event is concluded.

Such stadium seats are retained with respect to the stadium bench by means of hooks which are at the front edge of the frame of the stadium seat and which hook over a front wall of the stadium bench whereby to retain the stadium seat in position and prevent upwardly shifting movement thereof when the user leans back in the seat. It is conventional to provide such stadium seats with a frame having a seat portion which carries a cushion and a back portion which carries a back rest.

However, organizations sponsoring events in stadiums have found it desirable to provide, for their spectators, alumni and customers, seats which are semi-permanently attached to the stadium bench and which may remain in place during an entire season of events or, for that matter, throughout the year. This overcomes the necessity of carrying a stadium seat into the stadium for each event; buying or renting the same from a vendor; and requiring the vendor or others to pick up the seats after the event in the stadium is concluded. It also provides the user with a seat which is fixed at the position of use in the stadium and which may be counted on to be in place for a series of events in the stadium.

SUMMARY OF THE INVENTION

Accordingly, it is the object of this invention to provide a stadium seat which may be semi-permanently attached to a stadium bench, which bench is supported by a riser and presents a normally flat top and downwardly extending front and rear vertical walls.

It is an object of the invention to provide, in a stadium seat, clamping means for connecting the seat to the stadium bench by means of bolts which secure the clamp to the stadium seat and also bring the clamp into tight engagement with the rear wall of the stadium seat whereby to retain the seat in a fixed position on the stadium bench, the stadium seat normally occupying the space on the stadium bench to which the user of the stadium seat holds a ticket.

It is another object of this invention to provide a stadium seat having a cushion which overlies the stadium bench when the seat is in use, but which may be swung from a horizontal position of use on top of the stadium bench to a vertical position of storage wherein the cushion is suspended from the frame of the stadium seat beneath a portion of the stadium bench which extends beyond the riser, thereby placing the cushion in a position where it will not be damaged during storage.

It is a yet further object of this invention to provide a stadium seat having a frame and a cushion and wherein the cushion is connected to the front of the frame by means of a pair of loops which permit swinging movement of the cushion from a horizontal to a vertical position. In the vertical position, the cushion is out of the way and is essentially protected from the weather, such cushions usually being made of a weather impervious plastic material, all to the end that the cushion is maintained in good condition throughout a season and may be ready for use at any time for an event in the stadium merely by swinging a cushion to its horizontal, seating position.

DETAILED DESCRIPTION OF THE PREFERRED EMBODIMENT

The stadium seat 10 is intended to be used in connection with a stadium bench 12 which may be of wood, metal, plastic or other suitable material and which is supported on a riser 14 as is conventionally used in stepped seating arrangements for stadiums, theaters, and other similar venues for permitting a large number of spectators to view an event.

Figure 1:
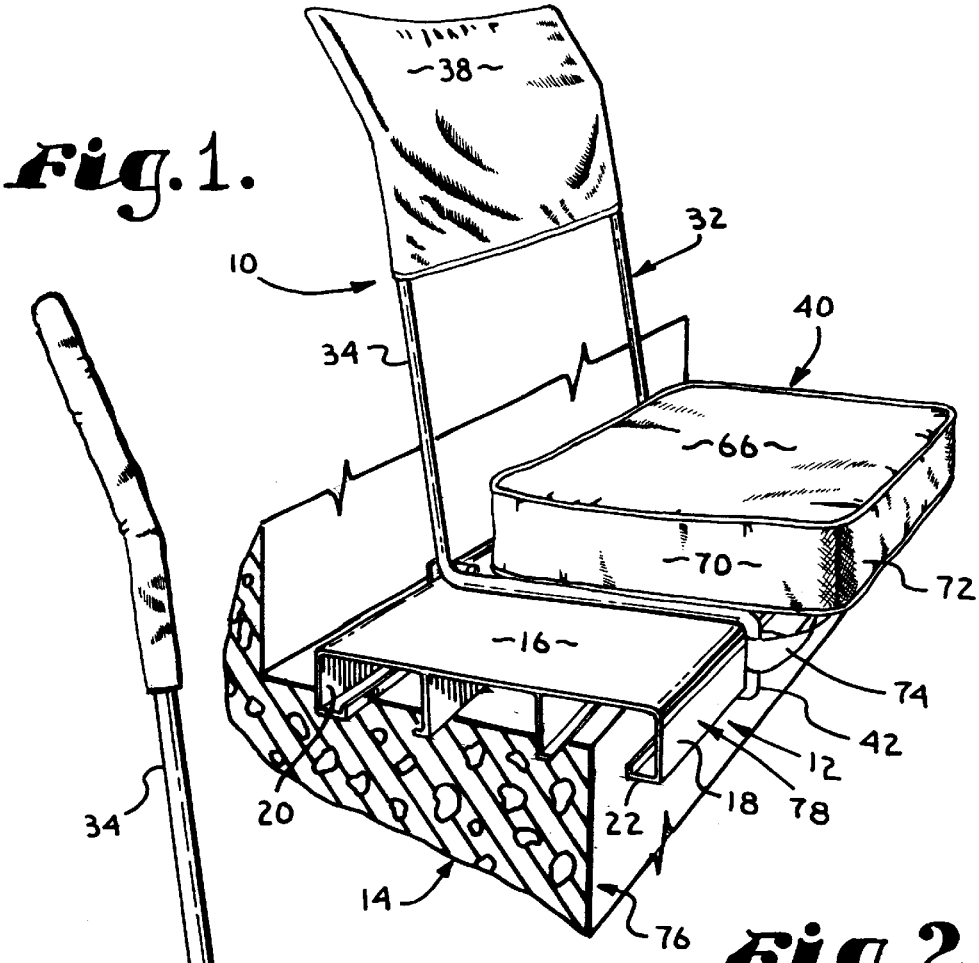
FIG. 1 is a perspective sectional view showing the stadium seat in position on a stadium bench, the stadium bench being supported by a riser.

The stadium bench conventionally presents a top flat surface 16 which is horizontally positioned. The stadium bench also includes opposed front and rear walls 18 and 20 respectively which extend downwardly from top surface 16, each of said walls having an inturned flange 22 and 24 respectively. Each of the flanges terminates in an upturned edge 26 and 28 respectively. The stadium bench 12 may also be provided with longitudinally extending strengthening ribs such as 30 inasmuch as the stadium benches are normally of substantial length and during use bear the weight of a large number of persons seated thereon. The stadium bench 12 is supported on the riser 14 through engagement of the top of the riser by the flange 24 and the ribs 30 as illustrated in FIG. 1.

The stadium seat, as illustrated, has a frame 32 which has a back portion 34 and a seat portion 36.

In the embodiment chosen for illustration, the stadium seat 10 includes a backrest 38 and a seat cushion 40. The frame is formed from metal rod material, although it will be appreciated that the seat frame 32 might be fabricated from other materials such as plastics, metal strips or the like, so long as such material is sufficient to carry the weight of the user of the seat.

The seat portion 36 of the frame 32, at its forwardmost end, is provided with hooks 42 which are spaced apart and which have a first leg 44 which extends downwardly along the front wall of the stadium seat 10 and a second leg 46 which extends rearwardly beneath the flange 22 whereby to hook the stadium seat over the stadium bench, as illustrated. It will be appreciated that this is accomplished by extending second legs 46 beneath the flange 24 and sliding the entire seat rearwardly with respect to the stadium bench so that the hooks are in a position of engagement with the front wall and flange of the stadium bench to thereby retain the seat in its position and against movement when the user leans backwardly against the backrest 38. Such construction is conventional in attaching stadium seats to stadium benches.

However, it is desired to semi-permanently attach the stadium seat 10 to the stadium bench 12 and this is accomplished by means of assemblies 48 at the rear of the seat portion 36 of the frame 32.

Each assembly 48 includes a clamp 50, the clamp presenting a skirt 52 which extends downwardly from a bolt 54, the assembly also including an inward extension 56. The skirt 52 overlies the rear wall 20 of the stadium bench 12 and the inward extension underlies the flange 24. Beyond flange 24 the clamp presents an upwardly extending lip 58 which extends upwardly at an angle of approximately 95 degrees so that the lip may be readily moved over the rear wall 20 and its flange 22 into position.

Figure 2:
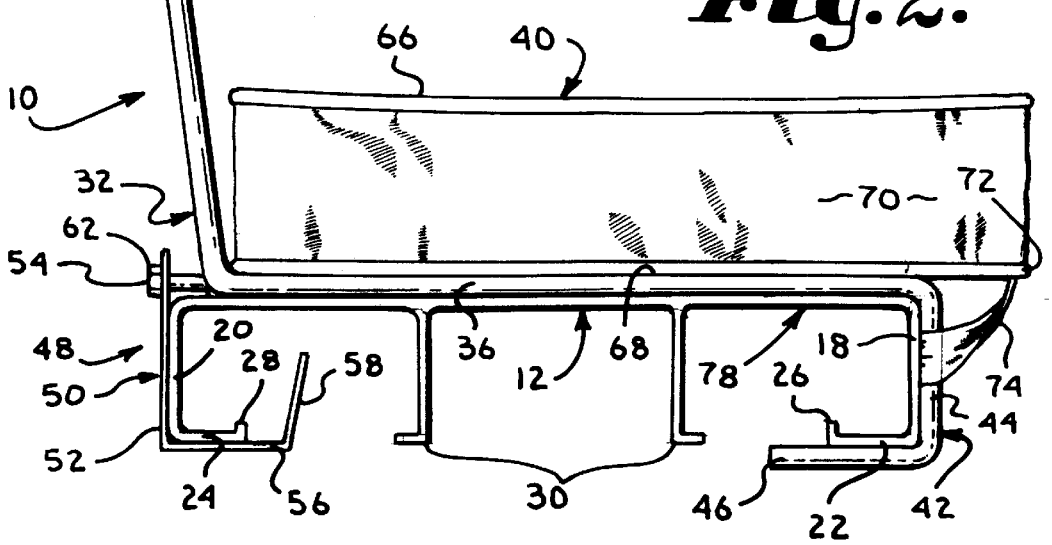
FIG. 2 is a side elevational view of the stadium seat in position on the stadium bench, with the cushion in a horizontal position of use.
Figure 3:
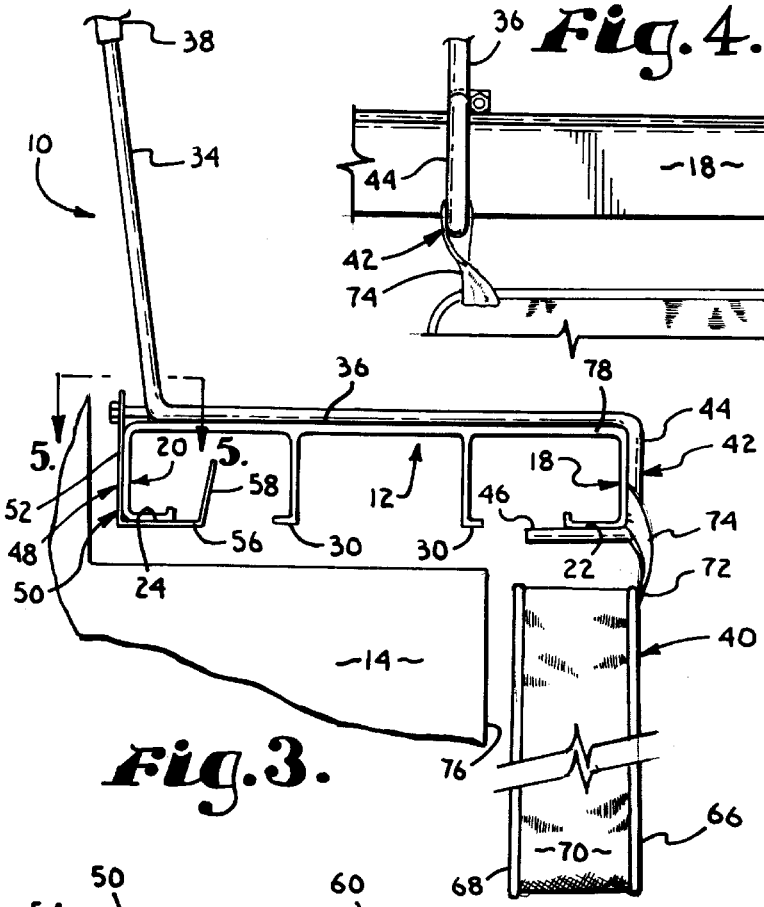
FIG. 3 is a side elevational view similar to that of FIG. 2 but showing the cushion in a vertical position of storage, a portion of the cushion being broken away, the riser being shown spaced from the stadium bench for purposes of illustration.
Figure 4:
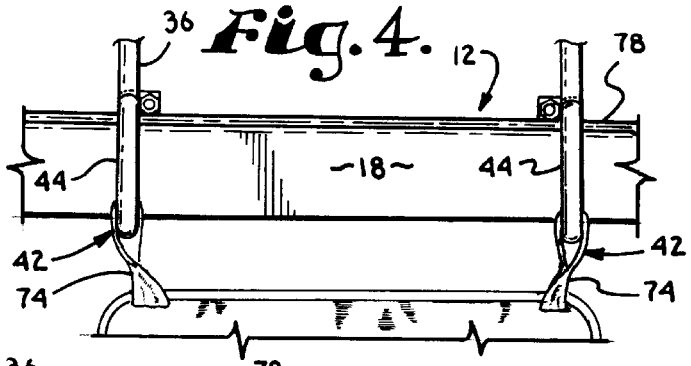
FIG. 4 is a fragmentary front elevational view showing the cushion as suspended from the seat frame during storage.
Figure 5:
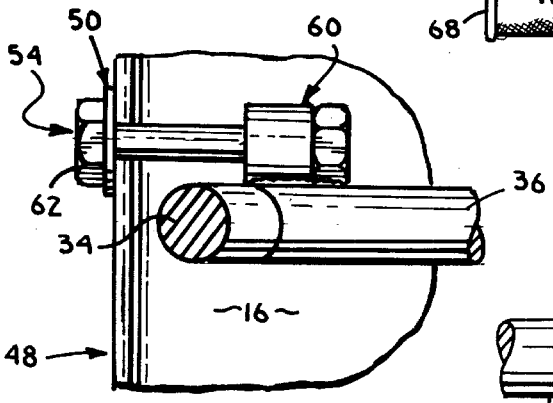
FIG. 5 is an enlarged fragmentary sectional view showing the means by which the clamp for attaching the seat to the stadium bench is connected with the frame of the seat.
Figure 6:
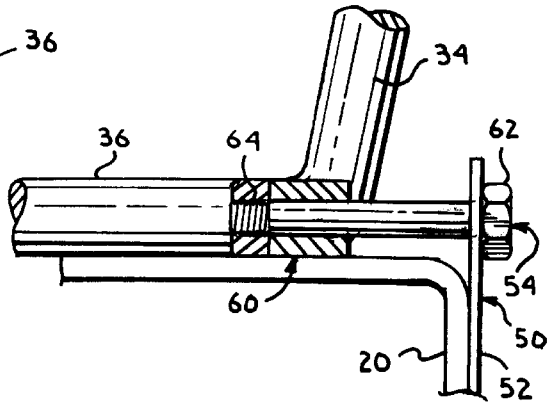
FIG. 6 is a fragmentary side elevational view, enlarged as in FIG. 5, and showing the bolt for securing the clamp to the seat.

When the assembly is positioned as shown in FIGS. 2 and 3, the bolt 54, which is threaded into a bolt housing 60, is tightened by rotating the bolt through head 62 whereby the threads 64 of the bolt are drawn inwardly with respect to the housing 60 thereby tightly moving the assembly into its final holding position as shown in FIGS. 2 and 3. This serves to semi-permanently attach the stadium seat to the stadium bench. Preferably a pair of bolts 54 are used, each having a corresponding assembly 48 at the rear portion of the stadium seat 10.

The use of spaced apart bolts such as 54 and the provision of a bolt housing such as 60 on each side of the seat portion 36 of the frame provides a secure anchor for the stadium seat with respect to the stadium bench. This attachment also precludes easy removal of the stadium seat whereby once it is positioned with respect to the stadium bench, it will remain in that position securely until the bolts 54 are unscrewed to permit removal of the assemblies 48 and therefore the stadium seat 12.

This is an important feature of the invention since it is contemplated that sponsors of stadiums might well "sell" the stadium seats such as 10 to their supporters such as, for instance, alumni of a school, whereby the stadium seat 10 would be semi-permanently attached to the stadium bench 12 at the seat location of the school supporter. Obviously, the stadium seat could contain school insignia or also indicia identifying the seat location.

In order to permit this semi-permanent placement of the stadium seat and retention thereof with respect to the stadium bench 12, it is desirable to preclude damage to the seat to the extent possible as by the weather or possibly by vandals.

To this end, the cushion 40 is movable from a use position, as illustrated in FIG. 1, where it is in a horizontal position resting on the top 16 of the stadium bench 12, to a vertical stored position as fragmentarily shown in FIG. 3 of the drawing.

The cushion 40 has a top wall 66; a bottom wall 68, and a circumscribing ring wall 70. The cushion is preferably of a weatherproof material and contains suitable stuffing whereby to give comfort to the user thereof.

The bottom wall 68 of the cushion 40 presents a front edge 72 which is coextensive in width with the seat cushion, the width of the cushion generally corresponding to the width of the seat portion 36 of the frame 32.

A pair of spaced loops 74 are secured to the front edge 72 of the cushion 40 and are also looped over the seat frame 36, whereby when the stadium seat is in position on the stadium bench, portions of the loops are effectively clamped between the downwardly extending legs 44 of the seat portion 36 of the frame and the front wall 18 of the stadium bench. This serves to retain the loops with respect to the stadium seat and the stadium bench. The portions of the loops between the leg 44 and wall 18 are shiftable therealong from the position shown in FIG. 2 when the seat cushion 40 is in a horizontal position to the position shown in FIG. 3 when the seat cushion 40 is in its vertical stored position.

Given this arrangement of the components, it is apparent that the seat cushion 40 may be "flipped" or swung from the position shown in FIG. 2 when it is in use to the position shown in FIG. 3 when it is in storage.

It is important to note that when the cushion 40 is in its storage position it is essentially entirely beneath the portion of the stadium bench 12 which extends beyond the vertical face 76 of the riser 14. The cushion 40, when it its stored position, is in generally parallel relationship with the face 76 of the riser and the portion of the cushion which is most exposed is the bottom thereof so that any damaging weather elements might more readily affect the bottom than the top on which the user will ultimately be seated when the cushion 40 is shifted to a position of use.

The ability to swing the cushion 40 to its stored position is important, since it is apparent that there are long periods of nonuse of the stadium seat 10, such as during an off season, and therefore it is important to preserve the integrity of the components thereof to the greatest extent possible.

The ability to store the cushion 40 in its vertical position beneath the portion 78 of the stadium bench 12 which extends beyond the vertical face 76 of the riser accomplishes this result in providing shelter for the cushion in its stored position.

The backrest 38 may be removed during periods of nonuse to facilitate the preservation thereof and may then be replaced in the event of use of the stadium seat, although it is contemplated that the backrest 38 would be of sufficiently strong or durable material so that removal would not be necessary.

Thus, there is presented a stadium seat 10 which is readily attachable to a conventional stadium bench such as 12, there being means for semi-permanently attaching the stadium seat 10 to the stadium bench 12 in the form of assemblies 48 as described in detail above. This permits the sponsor of the stadium seat 10 to have their very own seat in the stadium and to know that it will be present when the next event occurs in the stadium. The seat is maintained in its assigned position by virtue of the assemblies 48 connecting the stadium seat 10 to the stadium bench and the components of the stadium seat, most particularly the seat cushion 40, are preserved against damage by the elements or vandals by being suspended in a sheltered position beneath the outwardly extending portion 78 of the stadium bench 12.

Given the above described construction and operation, a stadium seat may be "sold" to an end user and then positioned in the stadium at its desired and assigned location so that it is semi-permanently attached and ready and available for use when the next event occurs.

Yet further, the construction of the stadium seat is such that the cushion may be moved to its stored position to facilitate cleanup of the stadium, but it is nevertheless permanently attached to the frame once the stadium seat is installed on the stadium bench.

The installation of the stadium seat on the stadium bench is such that no alteration or change of the stadium bench is necessary; that is, it is not required that holes be drilled in the stadium bench or it altered in any way to permit semi-permanent attachment of the stadium seat to the stadium bench and thus the stadium seats may be installed and removed without any change or damage to the conventionally provided stadium bench. The use of bolts permits quick and easy installation of the stadium seat merely by positioning the same and then tightening the bolts to move the clamping assemblies into position, as illustrated.

What is claimed is:

1. A seat for semi-permanent attachment to a stadium bench supported on a stadium riser, wherein the stadium bench presents a top, flat surface for seating, a front portion that extends beyond the stadium riser, opposed, spaced front and rear vertical walls extending downwardly from the top surface, and flanges extending inwardly from the bottom of each wall, said seat comprising:

a frame having a back and a seat portion;

a cushion connected to the seat portion and normally supported in a horizontal position over the stadium bench when the seat is attached to the stadium bench, the cushion being swingable from said horizontal position to a vertical position below the seat portion of the frame so that, when the seat is attached to the stadium bench and the cushion is in the vertical position, the cushion is beneath the front portion of the stadium bench; and an assembly for semi-permanently attaching the seat to the stadium bench, said assembly presenting at least one clamp, said clamp being operable to releasably attach the seat to the stadium bench, said clamp being affixed to the rear end of the seat portion of the frame by a bolt, the bolt being received within a threaded bolt housing on the seat portion of the me.

2. A seat as set forth in claim 1, there being at least one loop attached to the cushion and the frame for permitting the swinging of the cushion from said horizontal position to said vertical position.

3. A seat as set forth in claim 2, wherein the cushion, in its vertical position, is adapted to be essentially parallel to the adjacent riser and essentially fully beneath the front portion of the bench.

4. A seat as set forth in claim 1, there being a pair of loops attached to the front of the cushion and to the seat portion of the frame, the loops supporting the cushion when it is in the vertical position.

5. A seat as set forth in claim 4, the loops being movable with respect to the seat portion of the frame to permit swinging of the cushion from its vertical position to its horizontal position.

6. A seat as set forth in claim 4, the cushion having a top surface defined by a top wall of generally square shape, said top wall having a width generally corresponding to the width of the seat portion of the frame, the cushion having a lower surface being defined by a bottom wall adapted to be adjacent the top of the stadium bench when the seat is attached to the stadium bench, the bottom wall also having a generally square shape, the bottom wall presenting a front edge, the front edge extending along the length of the cushion and said cushion being further defined by a ring wall between the top and the bottom walls thereof.

7. A seat as set forth in claim 6, said loops being attached along the front edge of the bottom wall of the cushion, the loops allowing the cushion to be swingable from the horizontal position to the vertical position.

8. A seat as set forth in claim 1, the clamp presenting a skirt extending downwardly from the bolt so that, when the frame is attached to the stadium bench, the skirt extends along the rear wall of the stadium bench, the clamp further presenting an inward extension having an upwardly extending lip at its free end, the lip adapted to project above the flange on the rear wall of the stadium bench.

9. A seat as set forth in claim 8, said lip projecting upwardly at an angle of approximately 95 degrees from the free end of the inward extension.

* * * * *

UNITED STATES PATENT AND TRADEMARK OFFICE

CERTIFICATE OF CORRECTION

PATENT NO. : 6,352,306 B1
DATED : March 5, 2002
INVENTOR(S) : David L.Dreiling

It is certified that error appears in the above-identified patent and that said Letters Patent is hereby corrected as shown below:

Column 5,
Line 50, replace “me” with -- frame --

Signed and Sealed this

Fourth Day of March, 2003

JAMES E. ROGAN
*Director of the United States Patent and Trademark Office*